US005484764A

United States Patent [19]

Fiediuszko et al.

[11] Patent Number: 5,484,764

[45] Date of Patent: Jan. 16, 1996

[54] PLURAL-MODE STACKED RESONATOR FILTER INCLUDING SUPERCONDUCTIVE MATERIAL RESONATORS

[75] Inventors: Slawomir J. Fiediuszko, Palo Alto; John A. Curtis, Sunnyvale, both of Calif.

[73] Assignee: Space Systems/Loral, Inc., Palo Alto, Calif.

[21] Appl. No.: 975,803

[22] Filed: Nov. 13, 1992

[51] Int. Cl.[6] ..... H01P 1/201; H01B 12/06

[52] U.S. Cl. ..... 505/210; 505/700; 505/701; 505/866; 333/202; 333/204; 333/219; 333/99 S

[58] Field of Search ..... 333/202, 204, 333/219, 995; 505/1, 700, 701, 866, 210, 204

[56] References Cited

U.S. PATENT DOCUMENTS

| | | | |
|---|---|---|---|
| 2,922,968 | 1/1960 | Van Patten | 333/204 |
| 3,142,808 | 7/1964 | Gonda | 333/204 |
| 3,562,674 | 2/1971 | Gerst | 333/116 |
| 3,579,152 | 5/1971 | Moore | 333/204 |
| 3,857,114 | 12/1974 | Minet et al. | 333/204 X |
| 4,489,293 | 12/1984 | Fiedziuszko | 333/202 |
| 4,521,755 | 6/1985 | Carlson et al. | 333/204 X |
| 4,625,185 | 11/1986 | Burzi et al. | 333/204 |
| 5,136,268 | 8/1992 | Fiedziuszko et al. | 333/219 X |
| 5,172,084 | 12/1992 | Fiedziuszko et al. | 333/219 X |

FOREIGN PATENT DOCUMENTS

| | | | |
|---|---|---|---|
| 14503 | 1/1985 | Japan | 333/212 |
| 61-123302 | 11/1986 | Japan . | |
| 63-128801 | 6/1988 | Japan . | |
| 2-58901 | 2/1990 | Japan . | |
| 4167607 | 6/1992 | Japan | 333/202 DR |
| 1185440 | 10/1985 | U.S.S.R. . | |
| 1467619 | 3/1989 | U.S.S.R. | 333/204 |
| 1628109 | 2/1991 | U.S.S.R. | 333/203 |
| 2139427A | 3/1984 | United Kingdom . | |

OTHER PUBLICATIONS

I. H. Zabalawi, "Microwave Printed Circuit Linear Phase Selective Filter Design", Proceedings of the I.E.E.E., vol. 70 (1982) Jul., No. 7, New York, pp. 767–769.

Curtis et al., "Miniature Dual Mode Microstrip Filters", 1991 IEE MTT–S Digest, pp. 443–446.

Dworsky, "Stipline Filters—An Overview", Proceedings of the 37th Annual Frequency Control Symposium 1983, pp. 387–393.

Curtis et al., "Multi–Layered Planar Filters Based on Aperture Coupled, Dual Mode Microstrip or Stripline Resonators", 1992 IEEE MTT–S Digest, pp. 1203–1206.

Gronau et al., "Aperture–Coupling of A Rectangular Microstrip Resonator", Electronics Letters, 8th May 1986, vol. 22, No. 10, pp. 554–556.

*Primary Examiner*—Benny T. Lee

*Attorney, Agent, or Firm*—Perman & Green

[57] ABSTRACT

A filter for an electromagnetic signal is formed of a set of planar resonators, preferably of superconductor material, interspersed among a set of electrically conductive sheets, outermost ones of the sheets serving as ground planes, and the inner ones of the sheets having irises for coupling electromagnetic power between the resonators. The resonators and the sheets have a planar shape, are parallel to each other, and are stacked one upon the other. Dielectric material insulates and serves to support the resonators and the sheets in their respective locations. There are at least two resonators in the set of resonators, and at least one inner sheet of the set of sheets. A first coupling element serves to couple an electromagnetic signal to a first resonator of filter to excite in the first resonator a first mode of electromagnetic vibration in a plane defined by the axis and a point of coupling of the first coupling element. Each of the resonators, in a preferred embodiment of the invention, is provided with a perturbation, such as a notch or a tab in a peripheral portion of the resonator, distant from the plane and from a coupling point for inducing a second mode of electromagnetic vibration perpendicular to the first mode, thereby to provide the function of a multiple pole filter with half the number of resonators.

36 Claims, 3 Drawing Sheets

PLURAL-MODE STACKED RESONATOR FILTER INCLUDING SUPERCONDUCTIVE MATERIAL RESONATORS

BACKGROUND OF THE INVENTION

This invention relates to filters of electromagnetic signals, such as microwave signals, wherein the filter provides a bandpass function characterized by a multiple-pole transmission band and, more particularly, to the construction of a filter having a miniaturized configuration wherein a plurality of resonators of planar form are stacked one above the other to provide for plural modes of electromagnetic vibration within a single resonator. The resonators are spaced apart and supported by dielectric material with irises disposed between the resonators for coupling electromagnetic power among the resonators.

Filters are employed in numerous circuits for signal processing, communication, and other functions. Of particular interest herein are circuits, such as those which may be constructed on a printed circuit board, and are operable at microwave frequencies, such as frequencies in the gigahertz region. Such signals may be processed by transistors and other solid state devices, and may employ analog filters in the form of a series of cavity resonators, or resonators configured in microstrip form. By way of example, to provide a band-pass filter having an elliptic function or a Chebyshev response, and wherein a mathematical representation of the response is characterized by numerous poles, the filter has many sections. Each section has a single resonator, in the microstrip form of circuit, for each pole which is to be produced in the filter transfer function.

A problem arises in that the circuitry may be unduly large because of the space occupied by one or more filters employed in the circuitry. In the case of cavity-resonator filters, each cavity is physically large, particularly at lower frequencies, the physical size militating against the use of the cavity filters. Thus, in situations wherein there is limited space available for electronic circuits, such as in satellites which serve as part of a communication system, there is a need to reduce the size of filters, as well as to decrease the weight of filters employed in the signal processing circuitry.

SUMMARY OF THE INVENTION

The aforementioned problem is overcome and other advantages are provided by a filter which, in accordance with the invention, employs a series of resonators, the resonators being of generally planar configuration, wherein the resonators are stacked one upon the other in a spaced-apart arrangement of the resonators. In a preferred embodiment of the invention, the resonators are supported in their respective positions by layers of dielectric material. The dielectric material has a relatively high dielectric constant so as to reduce the wavelength of standing waves supported by each resonator, thereby reducing the overall configuration of the filter in terms of the transverse dimensions of the resonators. Each resonator is also provided with a perturbation, such as a notch or a tab located at a distance from an input feed point on one of the resonators. For example, in the case of a resonator having a square or rectangular shape, the perturbation would be located at a corner in each of the resonators, while the feed point of an input resonator would be located at the midpoint of a side of the resonator. The perturbation introduces a second mode of vibration of electromagnetic wave such that, at each of the resonators, there are two modes of vibration of a standing electromagnetic wave.

The resonators are disposed parallel to each other and coaxially about a common axis perpendicular to the resonators. Electrically conductive sheets in the form of metallic plates or foils are disposed between the resonators, each of the sheets being provided with an iris disposed symmetrically about the common axis. The irises serve to couple electromagnetic power from one resonator to the next resonator. The irises may be configured with circular symmetry, such as a circle or a cross having equal arms, or may have a elongated shape such as an ellipse or a cross with unequal arms. An iris with circular symmetry serves to couple power from both of the modes of a resonator equally to both of the modes of the next resonator of the series. In the case of the elongated iris, there is preferential coupling of power of one the modes, a tighter coupling, with a greater power transfer for the vibrational mode extending along the elongated direction of the iris, with reduced coupling for the mode extending along the transverse direction of the iris.

The use of the dual modes of vibration of the electromagnetic wave in each of the resonators provides for two poles of the mathematical expression of the filter transfer function for each resonator. Thereby, the number of required resonators is equal to only half of the number of poles of the transfer function. This reduces the overall dimensions of the filter in the direction of the height of the filter, as measured along the direction of the aforementioned common axis. It is advantageous to include top and bottom ground planes, which may be fabricated of metal plates or foil, wherein the stack of resonators is disposed between the ground planes. This reduces leakage and improves the quality of the resonances. In a preferred embodiment of the invention, the entire stack of resonators with the ground planes is enclosed within an enclosure, or housing, formed of electrically conductive material such as a metal.

The minimum configuration of the filter employs two resonators with a single iris between the two resonators. In the case wherein three or more resonators are employed, there are two or more irises employed. The electrically conducting sheets of the various irises are to be maintained at a common potential, such as ground potential. Accordingly, a grounding strap, which may be a wall of the aforementioned housing, is employed to provide electrical connection between the electrically conductive sheets having the irises. While the resonators may be fabricated of metal, it is advantageous to employ a superconductor material such as yttrium-barium-copper oxide (YBCO) which is operative to conduct electric current in a superconducting mode at a temperature less than or equal to 90 degrees Kelvin. Coupling between the resonators may also be varied by varying the spacing between the various resonators.

The coupling of electromagnetic power into and out of the filter can be attained by use of coupling elements such as probes and/or slots. By way of example, a probe may extend through a wall of the housing, be insulated therefrom by a sheath of insulation, and extend to a position adjacent a peripheral region of a resonator. Electromagnetic coupling is then attained by a gap between the probe and the resonator. The probe may be oriented perpendicularly to the plane of the resonator or parallel to the plane of the resonator. The point of coupling of the electromagnetic power to the resonator lies within a plane including the common axis and parallel to one of the two modes of vibration of the standing wave on the resonator. A second of the coupling elements, for extraction of power may be coupled to the same resonator, but, preferably, is coupled to another of the resonators. In a preferred embodiment of the invention, the second coupling element is positioned at a coupling point lying in a plane perpendicular to the aforementioned plane and including the common axis, thereby to couple the second of the two modes in a resonator. An alternative configuration of coupling element is a slot provided in one of the ground planes, the slot extending beneath the periphery of a resonator.

BRIEF DESCRIPTION OF THE DRAWING

The aforementioned aspects and other features of the invention are explained in the following description, taken in connection with the accompanying drawing wherein.

Identically labeled elements appearing in different ones of the figures refer to the same element in the different figures.

DETAILED DESCRIPTION

Figure 1:
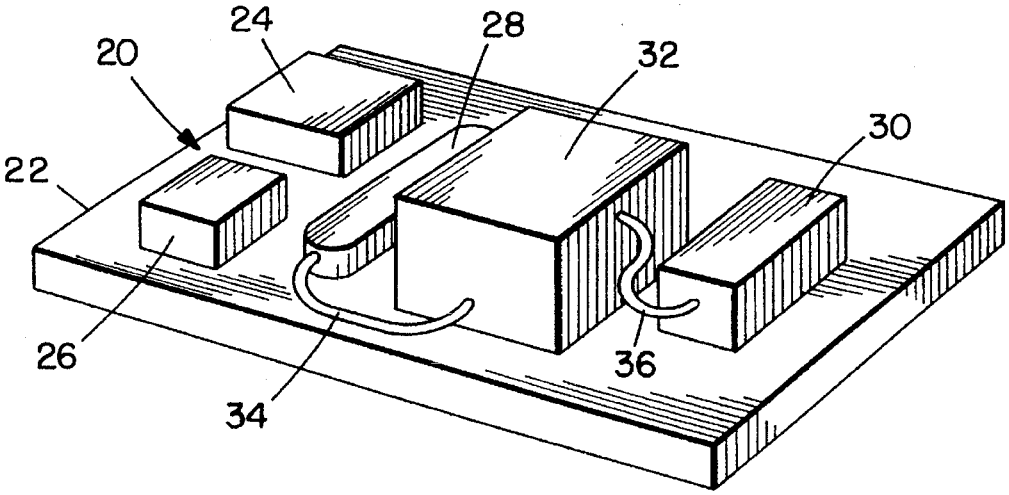
FIG. 1 is a stylized view of a circuit board having, as one of its components, a filter constructed in accordance with the invention.

FIG. 1 shows a circuit 20 constructed upon a circuit board 22 of insulating material and having components 24, 26, 28, and 30 mounted on the board 22 and interconnected via various conductors (not shown). By way of example, the components 24, 26, 28, and 30 may include an amplifier, a modulator, as well as converters between analog and digital signals. Also included in the circuit 20 is a filter 32 constructed in accordance with the invention, and connected by coaxial cables 34 and 36, respectively, to the circuit components 28 and 30.

Figure 2:
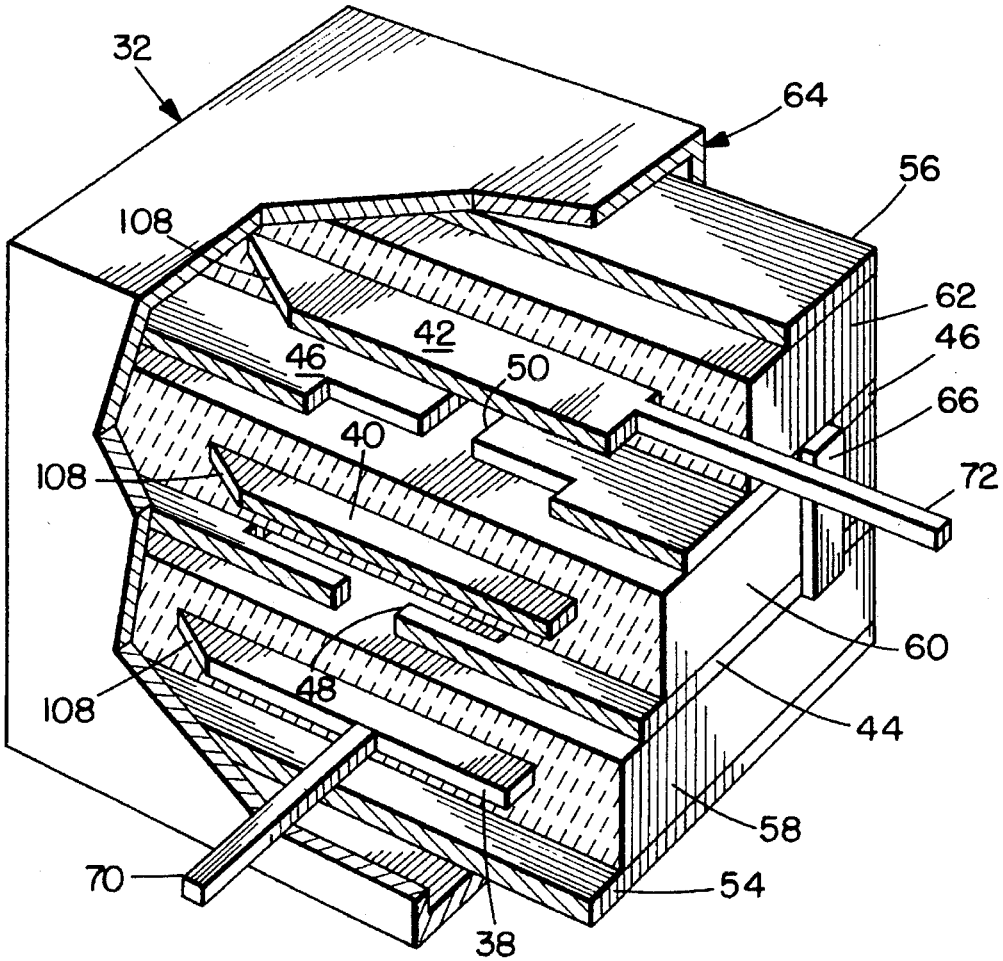
FIG. 2 is an isometric view of the filter of the invention, portions of the structure of the filter being cut away to show details of the construction.

In accordance with the invention, and as shown in FIG. 2, the filter 32 comprises a set of resonators 38, 40 and 42 with electrically conductive sheets 44 and 46 disposed between the resonators 38, 40, and 42. The sheet 44 is provided with an iris 48 for coupling electromagnetic signals between the resonators 38 and 40, and the sheet 46 is provided with an iris 50 for coupling electromagnetic signals between the resonators 40 and 42. The resonators 38, 40, and 42 are arranged symmetrically about a common axis 52 (FIG. 3) to form a stack of the resonators. A ground plane 54 is located at the bottom of the resonator stack facing the resonator 38, and a ground plane 56 is located at the top of the resonator stack facing the resonator 42. The resonator 38 is enclosed in a layer 58 of dielectric material which serves as a spacer between the ground plane 54 and the sheet 44. Similarly, the resonator 40 is enclosed within a layer 60 of dielectric material which supports the resonator 40 spaced apart from the sheets 44 and 46, and the resonator 42 is enclosed within a layer 62 of dielectric material which supports the resonator 42 in spaced apart relation between the sheet 46 and the ground plane 56. The foregoing components of the filter 32 including the resonators 38, 40, and 42, the sheets 44 and 46 and the ground planes 54 and 56 are enclosed within a housing 64 of electrically conductive material such as copper or aluminum which serves to shield the other components of the circuit 20 from electromagnetic waves within the filter 32, and to prevent leakage radiation of electromagnetic power from the filter 32.

The three resonators 38, 40 and 42 are presented by way of example, it being understood that, if desired, only two resonators may be provided in the resonator stack or, if desired, four, five, or more resonators may be employed in the resonator stack. Similarly, the two sheets 44 and 46 of FIG. 2 are presented by way of example, it being understood that only one sheet would be employed in the case of a stack of two resonators, and that three sheets would be employed in a stack of four resonators, there being one less sheet than the number of resonators. In one embodiment of the filter 32, the housing 64, the resonators 40, 42, and 44, the sheets 44 and 46, and the ground planes 54 and 56 are all constructed of electrically conductive material such as metal, copper or aluminum being a suitable metal, by way of example.

In an alternative embodiment of the invention, each of the resonators 38, 40, and 42 are formed of a superconductor material such as yttrium-barium-copper oxide (YBCO) which is operative to conduct electric current in a superconducting mode at a temperature less than or equal to 90 degrees Kelvin. Other similar superconductor materials such as a combination of copper oxide with other rare earth metals such as bismuth or thallium, and the substitution of strontium for barium may be employed, if desired, in constructing the resonators 38, 40, and 42. The superconductor form of the resonator is preferred because such a resonator provides for a higher Q (quality factor) in the operation of the filter 32, thereby to enable the attainment of a filter transfer function having a more sharply defined pass band than is obtainable with the resonators constructed of metal.

The sheets 44 and 46 are to operate at the same electric potential, and, accordingly, an electrically conductive strap 66 (FIG. 2), which may be fabricated of copper or aluminum, connects electrically the sheets 44 and 46 to provide for the equipotential surface. For larger resonator stacks wherein more of the sheets are employed, the strap 66 is extended to connect electrically all of the sheets to provide for a single equipotential surface. If desired, by way of alternative embodiment to be described in FIG. 3, each of the sheets 44 and 46, as well as such other sheets which may be present, connect to a wall of the housing 64 wherein the housing wall serves to electrically connect the sheets to provide the equipotential relationship. Also, by way of further alternative embodiment, the top and bottom walls of the housing 64 may serve the function of the ground planes 56 and 54 of FIG. 2 respectively.

All of the layers 58, 60, and 62 may be fabricated of the same dielectric material, a dielectric material such as quartz, or a ceramic such as alumina or lanthanum aluminate being a suitable dielectric material. Such dielectric materials are advantageous in that the layers 58, 60 and 62 of the dielectric material as well as the resonators 38, 40, and 42, and the sheets 44 and 46 may be constructed, one upon the other, by means of photolithography so as to provide for precisely dimensioned components of the filter 32 via a manufacturing process which permits accurate replication of the filters, thereby permitting mass production of filters having identical electrical characteristics. A further advantage in the use of the foregoing dielectric material is that the dielectric constant is significantly higher than that provided by air with the result that there is a substantial reduction in the physical dimensions of a standing wave produced upon interaction of any one of the resonators 38, 40, and 42 with an electromagnetic signal. This permits the physical size of the filter 32 to be made much smaller than a multi-sectioned cavity microwave filter of similar filter transfer function.

In the operation of a resonator, two basic modes of oscillation, or resonance, are obtainable wherein a cross-sectional dimension, or diameter, lying in a reference plane 68 (partially shown in FIG. 2, omitted in FIG. 3, but shown in FIG. 4) is equal to one-half wavelength of the electromagnetic signal, and wherein a cross-sectional dimension, or diameter, perpendicular to the reference plane 68 is equal to one-half wavelength of the electromagnetic signal. While resonances may be selected to be at the same frequency attained by equal resonator dimensions, generally, the filter transfer function is that of a band-pass filter described mathematically as having a plurality of poles, such as an elliptic function filter or a Chebyshev filter. In such a filter transfer function, each pole, and corresponding resonance, is at a slightly different frequency. Accordingly, the aforementioned diameter lying in the reference plane 68 and the aforementioned diameter laying perpendicularly to the reference plane 68 are of slightly different lengths. Each of the resonators 38, 40, and 42 are approximately square, or rectangular, in the sense that the cross-sectional dimensions may differ by one percent, or other amounts, by way of example. Furthermore, the cross-sectional dimensions of the resonator 40 differ slightly from those of the resonator 38 and, similarly the cross-sectional dimensions of the resonator 42 differ slightly from those of the resonators 38 and 40. This selection of resonator dimensions establishes a set of resonant wavelengths for the electromagnetic signals lying within the pass band of the filter 32. In the preferred embodiment of the invention, each of the resonators is operated only in its fundamental mode wherein a diameter is equal to a half-wavelength, rather than to a wavelength or higher order mode of vibration of the electromagnetic wave. Vertical spacing between the resonators 38, 40, and 42, as measured along the axis 52, is less than approximately one-quarter or one-tenth of a wavelength to avoid generation of spurious modes of vibration of the electromagnetic signal within the filter 32.

In the use of the superconductor material for construction of the resonators 38, 40, and 42, there is a need to maintain the filter 32 at a low temperature, less than or equal to the aforementioned 90 degrees Kelvin. This is accomplished readily by placing the filter 32 in a cold chamber (not shown) with the coaxial cables 34 and 36 (FIG. 1) leading out of the chamber to connect with the other components of the circuit 20. Alternatively, the components of the circuit 20 may employ transistors, such as gallium arsenide transistors, which are operable at the foregoing low temperature, in which case the entire circuit 20 may be located within the cold chamber.

Signals are coupled into and out of the filter 32 via some form of coupling means employing any one of several arrangements of coupling elements disclosed in the figures. For example, as shown in FIG. 2, coupling of signals into and out of the filter 32 is accomplished by means of probes 70 and 72 which represent extensions of the center conductors of the cables 34 and 36, and connect directly with the resonators 38 and 42, respectively. For example, the probe 70 may provide an input signal to the filter 32 while the probe 72 extracts an output signal from the filter 32. It is noted that the probe 70 lies within the reference plane 68 while the probe 72 is perpendicular to the reference plane 68. The probe 70 establishes a mode of electromagnetic vibration within the resonator 38 such that a standing wave develops wherein the wave vibrates within the reference plane 68. The probe 72 interacts with an electromagnetic wave vibrating in a plane perpendicular to the reference plane 68 for extracting power from a mode of vibration in the resonator 42 which is perpendicular to the reference plane 68. Alternatively, two probes 74 and 76 (FIG. 3) may extend in directions parallel to the resonators 38 and 42, respectively, and perpendicularly to a sidewall 78 of the housing 64. The probes 74 and 76 are spaced apart from the resonators 38 and 42 by gaps 80 and 82, respectively, for coupling of electromagnetic power to the resonator 38 and from the resonator 42. By way of alternative configuration in the arrangement of the coupling elements, the probes 74 and 76 lie in a common plane with the axis 52, such as the reference plane 68 or a plane perpendicular to the reference plane 68 and including the axis 52.

Figure 3:
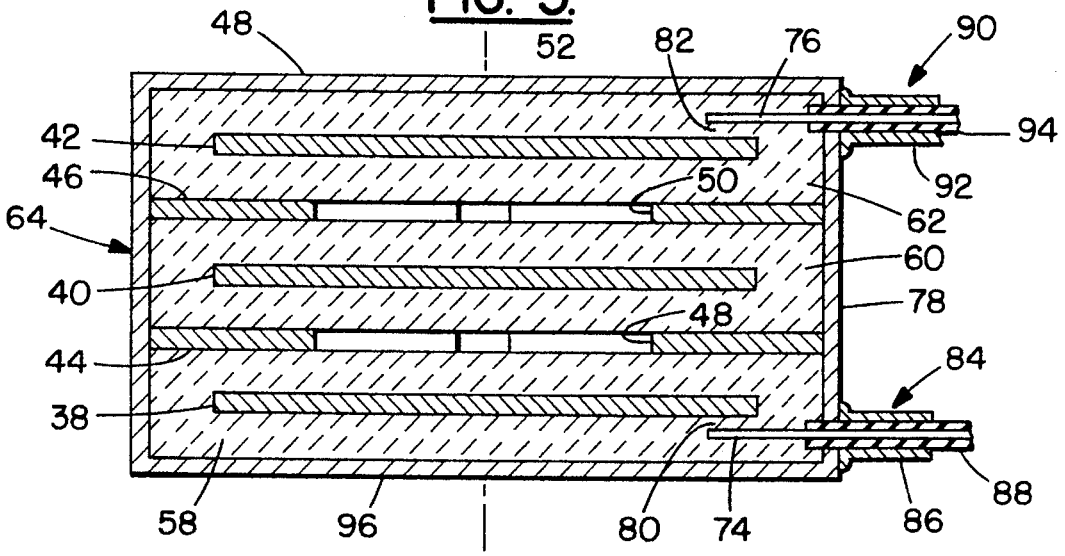
FIG. 3 is a sectional view taken along a central plane of the filter of the invention in an alternative embodiment employing an arrangement of coupling elements which differs from the arrangement of FIG. 2.

As shown in FIG. 3, each of the probes 74 and 76 extends from a coaxial connector mounted to the housing sidewall 78. In the case of the probe 74, a connector 84 comprises an outer cylindrical conductor 86 in electrical contact with the sidewall 78, and an electrically insulating sleeve 88 which positions the probe 74 centrally along an axis of the outer conductor 86 and encircled by the sleeve 88 to insulate the probe 74 from the outer conductor 86. Thereby, an extension of the probe 74 is also a central conductor of the connector 84. Similarly, an extension of the probe 76 is the center conductor of a coaxial connector 90 which has a cylindrical outer conductor 92 spaced apart from probe 76 by an electrically insulating sleeve 94. Also shown in the embodiment of FIG. 3 is the connection of the housing sidewall 78 to both of the sheets 44 and 46 to equalize their potential in the manner of the strap 66 of FIG. 2. In addition, in the embodiment of FIG. 3, the functions of the ground planes 54 and 56 of FIG. 2 are provided by a bottom wall 96 and a top wall 98, respectively, so that the additional physical structures of the ground planes 54 and 56 (FIG. 2) are not employed in the embodiment of FIG. 3.

Figure 4:
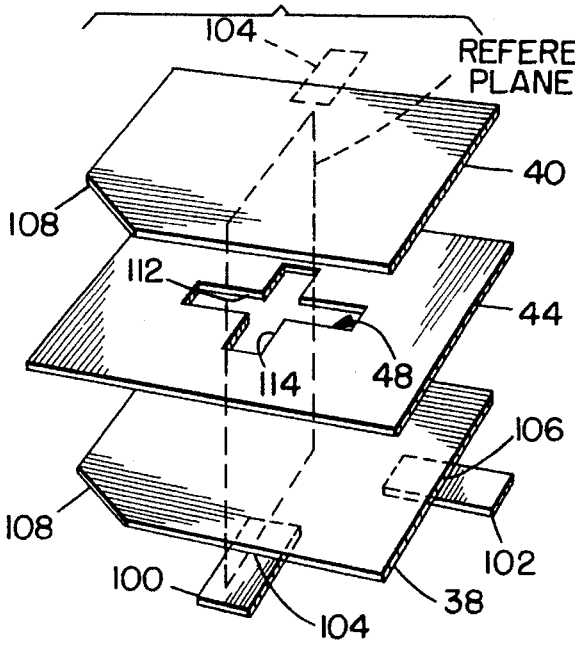
FIG. 4 is a simplified exploded view of a filter of the invention in accordance with a further embodiment having yet another arrangement of coupling elements, and disclosing details in the construction of perturbations of resonators of the filter, the resonators having a substantially square, or slightly rectangular shape.

In the simplified presentation of the filter 32, as presented in FIG. 4, only two of the resonators 38 and 40 are shown, along with a single sheet 44. Also, the corresponding layers 58 and 60 of dielectric material have been omitted to simplify the presentation. By way of alternative embodiment, the coupling elements are presented as pads 100 and 102 which extend partway beneath a peripheral portion of the resonator 38 and are spaced apart therefrom by gaps 104 and 106. Unlike the arrangement of coupling elements of FIGS. 2 and 3, in FIG. 4, both of the coupling elements, namely the pads 100 and 102 are coupled to the same resonator, namely the resonator 38. The pad 100 lies within the reference plane 68, and the pad 102 lies in the plane perpendicular to the reference plane 68. By way of further embodiment, a connecting element in the form of a pad 107, shown in phantom, may be located within the reference plane 68 adjacent the resonator 40, in lieu of the pad 102 for coupling signals from the filter 32.

In accordance with an important feature of the invention, at least one of the resonators of the filter 32, and preferably all of the resonators, such as the resonators 38, 40, and 42 (FIGS. 2 and 3) are provided with a perturbation located in a peripheral region of a resonator at a site distant from the reference plane 68 and from a coupling element. One form of construction of the perturbation is a notch 108 shown in FIG. 4 and shown partially in FIG. 2. An alternative form of the perturbation is a tab 110 shown in FIG. 5. The perturbation causes an interaction between the two orthogonal modes of vibration of electromagnetic waves within any one of the resonators 38, 40, and 42, such that the presence of any one of the modes induces the presence of the other mode. Thus, by way of example, upon excitation of a mode of vibration in the reference plane 68 by application of a signal on the pad 100 (FIG. 4), the perturbation, in the form of the notch 108, introduces a coupling between the modes such that the mode of vibration in the reference plane 68 induces vibration also in the plane perpendicular to the reference plane 68. Thereby, upon application of an electromagnetic signal to the tab 100, both orthogonal modes of vibration of electromagnetic standing waves appear at the resonator 38.

In FIG. 4, the iris 48 in the sheet 44 is in the form of a cross having transverse arms 112 and 114 located on radii extending from the axis 52. The arm 114 lies within the reference plane 68 for coupling energy of the vibrational mode at the resonator 38 lying within the reference plane 68 to the resonator 40. Similarly, the arm 112 is oriented perpendicularly to the reference plane 68 for coupling energy of the vibrational mode at the resonator 38 lying perpendicular to the reference plane 68 to the resonator 40. Thereby, two orthogonal modes of vibration appear also at the resonator 40. In a similar fashion, the iris 50 (shown in FIGS. 2 and 3) couples electromagnetic energy from the two modes of vibration upon the resonator 40 to the resonator 42. In view of the fact that each of the resonators carries two modes of vibration of electromagnetic energy, coupling elements can be applied to any one or any pair of the resonators, and may be disposed in a common vertical plane, as in FIG. 3, or in transverse vertical planes, as in FIG. 2.

In the iris 48, the arms 112 and 114 may be of equal length and width to provide for an equal amount of coupling of the corresponding electromagnetic modes. Alternatively, if desired, one of the arms, such as the arm 114 may be made shorter than the other arm 112. This provides for reduced coupling of the mode which is parallel to the plane 68 relative to the amount of coupling of the mode which is perpendicular to the plane 68. Such variation in the amount of coupling among the various modes is a factor to be selected for attaining a desired filter transfer function. In similar fashion, cross arms of the iris 50 may be adjusted for equal or unequal amounts of coupling of the corresponding electromagnetic modes. Coupling among modes of different ones of the resonators may also be adjusted by varying spacing between neighboring ones of the resonators, as will be described with reference to FIG. 14. It is noted that the foregoing discussion in the generation of the orthogonal modes of vibration applies also to circular resonators such as the resonators 116 and 118 of FIG. 5. The same form of sheet, such as the sheet 44 and the same form of iris, such as the iris 48 may be employed with the circular resonators 116 and 118. Similarly, the coupling elements, such as the pads 100 and 102 may be employed also with the corresponding circular resonators 116 and 118 of FIG. 5.

Figure 6:
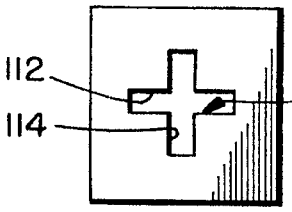
FIGS. 6, 7, 8 and 9 show different embodiments of a coupling iris employed in the filter.
Figure 7:
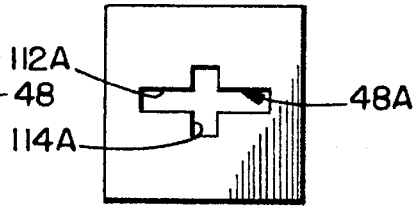
Figure 8:
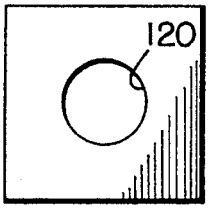
Figure 9:
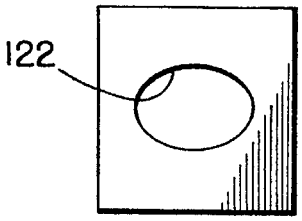

FIG. 6 shows a plan view of the iris 48 in the situation where the two arms 112 and 114 are equal. FIG. 7 shows a plan view of an alternative configuration of the iris, namely an iris 48A having an arm 114A which is shorter than the arm 112A. If desired, the shape of the iris can be altered such that, instead of use of an iris having the shape of a cross, an iris in the shape of a circle or an ellipse may be employed. FIG. 8 shows a plan view of a circular iris 120, and FIG. 9 shows a plan view of an elliptical iris 122. The symmetry of the circular iris 120 provides for an equal amount of coupling of two orthogonal electromagnetic modes. In the case of the iris 122 of FIG. 9, the long dimension of the iris 12 may be positioned perpendicularly to the reference plane 68 (FIG. 4) in which case the electromagnetic mode resonating in the plane perpendicular to the reference plane 68 will be coupled more strongly to a neighboring resonator than the orthogonal electromagnetic mode which is parallel to the reference plane 68.

Figure 5:
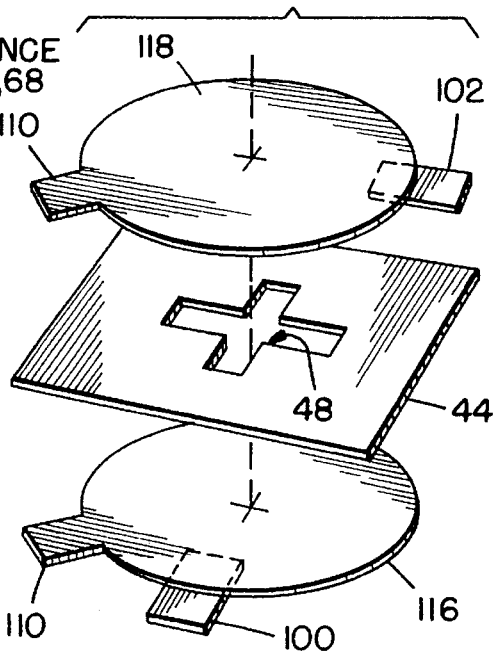
FIG. 5 is a further simplified exploded view of the filter of the invention wherein coupling elements are provided in accordance with yet a further arrangement, and wherein the resonator perturbations are constructed in accordance with a further embodiment, the resonators having a circular shape.
Figure 10:
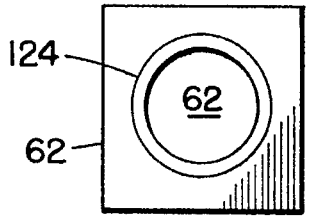
FIGS. 10 and 11 show simplified schematic views of the filter of the invention disclosing a resonator constructed in accordance with a further embodiment having an annular form, the resonator shown disposed upon a layer of dielectric material wherein, in FIG. 10, the resonator has a circular annular shape and wherein, in FIG. 11, the resonator has an elliptical annular shape.
Figure 11:
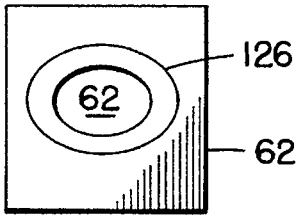

The resonator need not be substantially square as shown in FIG. 4, or substantially circular as shown in FIG. 5, but may, if desired, be provided with an annular form as shown in FIGS. 10 and 11. FIG. 10 shows a plan view of an annular resonator 124 shown positioned, schematically within a layer of dielectric material, such as the layer 62. In FIG. 11, there is shown schematically a resonator 126 disposed upon the layer 62 of dielectric material and having an elliptical annular form, as compared to the circular annular form of FIG. 10.

Figure 12:
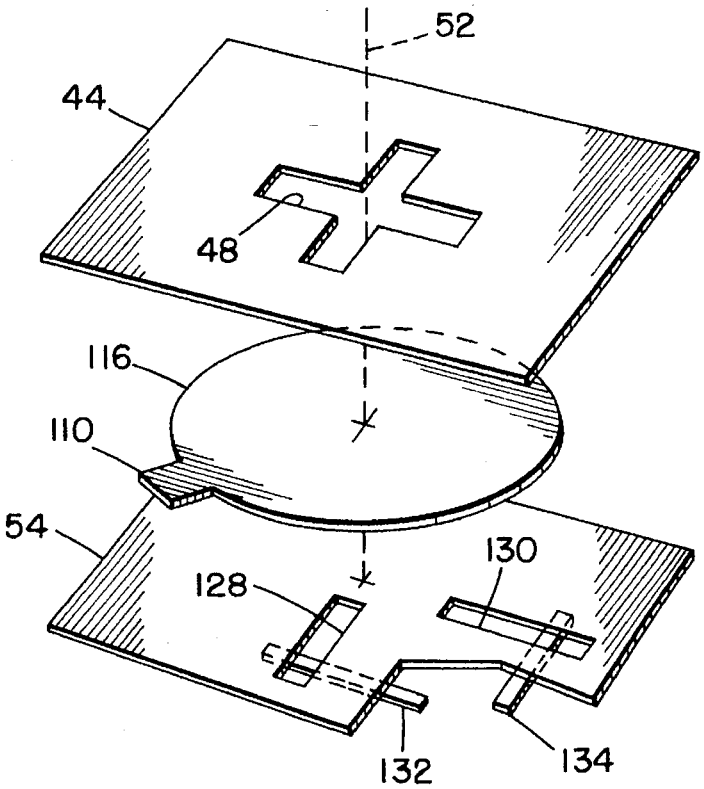
FIG. 12 discloses a simplified exploded view of the filter presenting coupling structure in the form of a pair of slots, and wherein the resonator may be slightly elliptical in shape.
Figure 13:
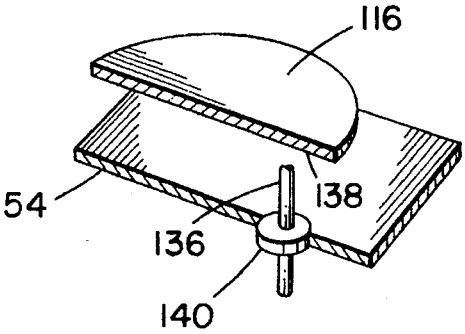
FIG. 13 shows a fragmentary view of a further coupling structure wherein a probe is oriented perpendicularly to the plane of a resonator.

FIG. 12 shows a simplified exploded view of a portion of a filter disclosing the bottom ground plane 54, the resonator 116, and the electrically-conductive sheet 44 with the iris 48 therein. Instead of the probes 70 and 72 of FIG. 2, or the probes 74 and 76 of FIG. 3, or the pads 100 or 102 of FIGS. 4 and 5, FIG. 12 shows a further form of coupling element wherein a pair of orthogonal coupling elements are formed as slots 128 and 130 disposed in the ground plane 54. The slot 128 lies in the reference plane 68 (FIG. 4), and the slot 130 is perpendicular to the reference plane 68, and lies on a radius extending from the axis 52. Probes 132 and 134 are disposed on the back side of the ground plane 54, opposite the resonator 116, and are oriented perpendicularly to the slots 128 and 130, respectively, and are positioned parallel to and in spaced-apart relation to the ground plane 54. The probes 132 and 134 excite an electromagnetic signal in the slots 128 and 130, respectively, with the slots 128 and 130 serving to excite orthogonal modes of electromagnetic waves within the resonator 116. In the fragmentary view of FIG. 13, there is shown yet another embodiment of coupling element wherein a probe 136 is oriented perpendicularly to the resonator 116 and spaced apart therefrom by a gap 138. The probe 136 is mounted to the ground plane 54 and passes through the ground plane 54 via an aperture therein by means of an electrically-insulating sleeve 140, disposed within the aperture. The sleeve 140 serves to support the probe 136 within the ground plane 54.

Figure 14:
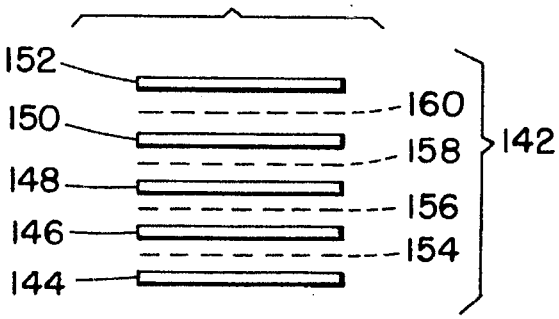
FIG. 14 is a schematic representation of a stack of five resonators, indicated in solid line, with a set of four electrically-conductive sheets, indicated as dashed lines, interposed between the resonators.

FIG. 14 shows a stack 142 of resonators 144, 146, 148, 150 and 152 with a set of electrically conducting sheets 154, 156, 158 and 160 disposed therebetween. The sheets are understood to include coupling irises (not shown in FIG. 14). The resonator stack 142 demonstrates an embodiment of the invention having additional resonators and sheets with coupling irises therein. FIG. 14 also demonstrates a variation of coupling strength between various ones of the resonators attained by a variation in spacing between the various resonators For example, the central resonator 148 may be spaced at relatively large distance between the resonators 146 and 150, as compared to the relatively small spacing between the resonators 144 and 146 and the relatively small spacing between the resonators 150 and 152. In the embodiment of FIG. 14, the resonators may have the same form as shown in FIG. 4 wherein the perturbations, shown as notches 108, are oriented at 45 degrees relative to the reference plane 68. Alternatively, the resonators (FIG. 14) may have the same form as the resonators of FIG. 5 wherein the perturbations, shown as tabs 110 are oriented at 45 degrees relative to the reference plane 68 (FIG. 4). In all of the embodiments, the resonators and the electrically-conducting sheets have a planar form, and are positioned symmetrically about the central axis 52. If desired, a single-mode filter may be implemented in a similar stacked configuration by deleting the foregoing perturbation, and by providing that the input and the output coupling elements are coplanar. The principles of the invention can be obtained with a stack of resonators, such as the stack 142 without use of the ground planes 54 and 56 (FIG. 2), however, there would be significant leakage of electromagnetic energy which might interfere with operation of other components of he circuit 20 (FIG. 1), and wherein such leakage might decrease the Q of the filter transfer function. Use of the ground planes 54 and 56 on the bottom and the top ends of the stack of resonators is preferred because it tends to confine the electromagnetic energy within the region of the filter. Still further beneficial results are obtained by mounting the resonator stack within an electrically conductive enclosure, such as the housing 64 which retains the electromagnetic energy within the filter, and prevents leakage of the energy to other components of the circuit 20.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A filter for an electromagnetic signal comprising:

a set of resonators spaced apart from each other and disposed about a common axis, each of said resonators extending parallel to each other and transversely of said axis;

a set of electrically conductive sheets interposed between successive ones of said resonators and spaced apart from said resonators, said electrically conductive sheets being parallel to each other, there being at least two resonators in said set of resonators, there being at least one sheet in said set of sheets, each of said sheets having a corresponding iris, the irises in respective ones of said sheets being operative for coupling said electromagnetic signal between neighboring ones of said resonators; and coupling means disposed adjacent to at least one resonator of said set of resonators for coupling said electromagnetic signal to said filter; and wherein a spacing between two neighboring resonators of said set of resonators is less than approximately one-quarter wavelength of the electromagnetic signal to avoid generation of spurious modes.

2. A filter according to claim 1 wherein said coupling means includes a coupling element positioned for coupling said electromagnetic signal to a point on said at least one resonator of said set of resonators, said point being distant from said axis, said coupling element exciting in said at least one resonator a first mode of electromagnetic vibration in a reference plane defined by said axis and a line between the axis and said point.

3. A filter according to claim 2 wherein said coupling element comprises a probe parallel to and spaced apart from a peripheral region of said at least one resonator of said set of resonators.

4. A filter according to claim 2 wherein said coupling element comprises a pad extending from a peripheral region of said at least one resonator of said set of resonators.

5. A filter according to claim 1 further comprising dielectric material disposed between an individual sheet of said set of sheets and individual one of said resonators neighboring said individual sheet.

6. A filter according to claim 1 further comprising an electrically conductive enclosure enclosing said set of resonators and said set of sheets.

7. A filter according to claim 6 wherein said enclosure connects electrically with said sheets to realize an equipotential surface.

8. A filter according to claim 1 wherein each of said resonators of said set of resonators comprises superconductor material.

9. A filter according to claim 1 wherein each of said resonators of said set of resonators comprises metal.

10. A filter according to claim 1 wherein said set of resonators comprises at least three resonators and wherein the spacings between said at least three resonators are equal.

11. A filter for an electromagnetic signal comprising:

a set of resonators spaced apart from each other and disposed about a common axis, each of said resonators extending parallel to each other and transversely of said axis;

a set of electrically conductive sheets interposed between successive ones of said resonators and spaced apart from said resonators, said electrically conductive sheets being parallel to each other, there being at least two resonators in said set of resonators, there being at least one sheet in said set of sheets, each of said sheets having a corresponding iris, the irises in respective ones of said sheets being operative for coupling said electromagnetic signal between neighboring ones of said resonators; and coupling means disposed adjacent to at least one resonator of said set of resonators for coupling said electromagnetic signal to said filter;

wherein said coupling means includes a coupling element positioned for coupling the electromagnetic signal to a point on said at least one resonator, said point being distant from said axis, said coupling element exciting in said at least one resonator a first mode of electromagnetic oscillation in a reference plane defined by said axis and a line between the axis and said point;

said at least one resonator is comprised of superconductor material and comprises a perturbation distant from said plane for inducing a second mode of electromagnetic oscillation perpendicular to said plane; and a spacing between two neighboring resonators of said set of resonators is less than approximately one-quarter wavelength of the electromagnetic signal to avoid generation of spurious modes.

12. A filter according to claim 11 wherein said one resonator of said set of resonators has a circular shape, said reference plane passes through a center of said at least one resonator, said center being located along said axis, and said perturbation is located on a further axial plane of said filter, said further axial plane being oriented at substantially 45 degrees relative to said reference plane.

13. A filter according to claim 11 wherein the iris in said at least one sheet has a first dimension parallel to said reference plane and a second dimension perpendicular to said reference plane, said first and said second dimensions differing in length for providing a differential amount of coupling of electromagnetic oscillations between said first and said second modes.

14. A filter according to claim 13 wherein said iris has the shape of a cross.

15. A filter according to claim 11 wherein said perturbation comprises a tab disposed in a peripheral portion of said at least one resonator of said set of resonators.

16. A filter according to claim 11 wherein said coupling means further comprises a second coupling element positioned for coupling said electromagnetic signal to a point on a second resonator of said set of resonators and distant from said axis.

17. A filter according to claim 16 wherein the coupling point on said second resonator is disposed in said reference plane.

18. A filter for an electromagnetic signal comprising:

a set of resonators spaced apart from each other and disposed about a common axis, each of said resonators extending parallel to each other and transversely of said axis;

a set of electrically conductive sheets interposed between successive ones of said resonators and spaced apart from said resonators, said electrically conductive sheets being parallel to each other, there being at least two resonators in said set of resonators, there being at least one sheet in said set of sheets, each of said sheets having a corresponding iris, the irises in respective ones of said sheets being operative for coupling said electromagnetic signal between neighboring ones of said resonators; and coupling means disposed adjacent to at least one resonator of said set of resonators for coupling said electromagnetic signal to said filter;

wherein said coupling means includes a coupling element positioned for coupling the electromagnetic signal to a point on said at least one resonator, said point being distant from said axis, said coupling element exciting in said at least one resonator a first mode of electromagnetic oscillation in a reference plane defined by said axis and a line between the axis and said point; and said at least one resonator is comprised of superconductor material and comprises a perturbation distant from said plane for inducing a second mode of electromagnetic oscillation perpendicular to said plane, and said perturbation comprises a notch in a peripheral portion of said at least one resonator of said set of resonators.

19. A filter for an electromagnetic signal comprising:

a set of resonators spaced apart from each other and disposed about a common axis, each of said resonators extending parallel to each other and transversely of said axis;

a set of electrically conductive sheets interposed between successive ones of said resonators and spaced apart from said resonators, said electrically conductive sheets being parallel to each other, there being at least two resonators in said set of resonators, there being at least one sheet in said set of sheets, each of said sheets having a corresponding iris, the irises in respective ones of said sheets being operative for coupling said electromagnetic signal between neighboring ones of said resonators; and coupling means disposed adjacent to at least one resonator of said set of resonators for coupling said electromagnetic signal to said filter;

wherein said coupling means includes a coupling element positioned for coupling the electromagnetic signal to a point on said at least one resonator, said point being distant from said axis, said coupling element exciting in said at least one resonator a first mode of electromagnetic oscillation in a reference plane defined by said axis and a line between the axis and said point;

the filter further comprises a first ground plane and a second ground plane disposed transversely to said axis and spaced apart from said set of resonator, said at least one resonator is comprised of superconductor material, said set of resonators being located between said first and said second ground planes, said at least one resonator facing said first ground plane and a second of said resonators facing said second ground plane, each of said ground planes being parallel to said resonators and to said at least one sheet; and said coupling element comprises a probe perpendicular to said at least one resonator and extending through said first ground plane.

20. A filter for an electromagnetic signal comprising:

a set of resonators spaced apart from each other and disposed about a common axis, each of said resonators extending parallel to each other and transversely of said axis;

a set of electrically conductive sheets interposed between successive ones of said resonators and spaced apart from said resonators, said electrically conductive sheets being parallel to each other, there being at least two resonators in said set of resonators, there being at least one sheet in said set of sheets, each of said sheets having a corresponding iris, the irises in respective ones of said sheets being operative for coupling said electromagnetic signal between neighboring ones of said resonators; and coupling means disposed adjacent to at least one resonator of said set of resonators for coupling said electromagnetic signal to said filter;

wherein said coupling means includes a coupling element positioned for coupling the electromagnetic signal to a point on said at least one resonator, said point being distant from said axis, said coupling element exciting in said at least one resonator a first mode of electromagnetic oscillation in a reference plane defined by said axis and a line between the axis and said point; and said at least one resonator is comprised of superconductor material and comprises a perturbation distant from said plane for inducing a second mode of electromagnetic oscillation perpendicular to said plane, said at least one resonator has a rectangular shape, and said perturbation is located in a corner of said at least one resonator of said set of resonators.

21. A filter for an electromagnetic signal comprising:

a set of resonators spaced apart from each other and disposed about a common axis, each of said resonators extending parallel to each other and transversely of said axis;

a set of electrically conductive sheets interposed between successive ones of said resonators and spaced apart from said resonators, said electrically conductive sheets being parallel to each other, there being at least two resonators in said set of resonators, there being at least one sheet in said set of sheets, each of said sheets having a corresponding iris, the irises in respective ones of said sheets being operative for coupling said electromagnetic signal between neighboring ones of said resonators; and coupling means disposed adjacent to at least one resonator of said set of resonators for coupling said electromagnetic signal to said filter;

wherein said coupling means includes a coupling element positioned for coupling the electromagnetic signal to a point on said at least one resonator, said point being distant from said axis, said coupling element exciting in said at least one resonator a first mode of electromagnetic oscillation in a reference plane defined said axis and a line between the axis and said point; said at least one resonator is comprised of superconductor material and comprises a perturbation distant from said plane for inducing a second mode of electromagnetic oscillation perpendicular to said plane; and said at least one resonator has a square shape, and said perturbation is located in a corner of said at least one resonator of said set of resonators.

22. A filter for an electromagnetic signal comprising:

a set of resonators spaced apart from each other and disposed about a common axis, each of said resonators extending parallel to each other and transversely of said axis;

a set of electrically conductive sheets interposed between successive ones of said resonators and spaced apart from said resonators, said electrically conductive sheets being parallel to each other, there being at least two resonators in said set of resonators, there being at least one sheet in said set of sheets, each of said sheets having a corresponding iris, the irises in respective ones of said sheets being operative for coupling said electromagnetic signal between neighboring ones of said resonators; and coupling means disposed adjacent to at least one resonator of said set of resonators for coupling said electromagnetic signal to said filter;

a ground plane located outside said set of resonators and parallel to said at least one resonator;

wherein said coupling means includes a coupling element positioned for coupling the electromagnetic signal through said ground plane to a point on said at least one resonator, said point being distant from said axis, said coupling element exciting in said at least one resonator a first mode of electromagnetic oscillation in a reference plane defined by said axis and a line between the axis and said point;

said at least one resonator comprises a perturbation distant from said plane for inducing a second mode of electromagnetic oscillation perpendicular to said plane; and the iris in said at least one sheet has a circular symmetry about a center of the iris for coupling oscillations of said first mode and said second mode equally between neighboring ones of said resonators.

23. A filter for an electromagnetic signal comprising:

a set of resonators spaced apart from each other and disposed about a common axis, each of said resonators extending parallel to each other and transversely of said axis;

a set of electrically conductive sheets interposed between successive ones of said resonators and spaced apart from said resonators, said electrically conductive sheets being parallel to each other, there being at least two resonators in said set of resonators, there being at least one sheet in said set of sheets, each of said sheets having a corresponding iris, the irises in respective ones of said sheets being operative for coupling said electromagnetic signal between neighboring ones of said resonators; and coupling means disposed adjacent to at least on resonator of said set of resonators for coupling said electromagnetic signal to said filter;

wherein said coupling means includes a coupling element positioned for coupling the electromagnetic signal to a point on said at least one resonator, said point being distant from said axis, said coupling element exciting in said at least one resonator a first mode of electromagnetic oscillation in a reference plane defined by said axis and a line between the axis and said point;

said at least one resonator is comprised of superconductor material and comprises a perturbation distant from said plane for inducing a second mode of electromagnetic oscillation perpendicular to said plane; and said at least one resonator of said set of resonators has an annular shape, and said perturbation is located on a further axial plane of said filter, said further axial plane being oriented at substantially 45 degrees relative to said reference plane.

24. A filter for an electromagnetic signal comprising:

a set of resonators spaced apart from each other and disposed about a common axis, each of said resonators extending parallel to each other and transversely of said axis;

a set of electrically conductive sheets interposed between successive ones of said resonators and spaced apart from said resonators, said electrically conductive sheets being parallel to each other, there being at least two resonators in said set of resonators, there being at least one sheet in said set of sheets, each of said sheets having a corresponding iris, the irises in respective ones of said sheets being operative for coupling said electromagnetic signal between neighboring ones of said resonators; and coupling means disposed adjacent to at least one resonator of said set of resonators for coupling said electromagnetic signal to said filter;

wherein said coupling means includes a coupling element positioned for coupling the electromagnetic signal to a point on said at least one resonator, said point being distant from said axis, said coupling element exciting in said at least one resonator a first mode of electromagnetic oscillation in a reference plane defined by said axis and a line between the axis and said point; and said at least one resonator is comprised of superconductor material and comprises a perturbation distant from said plane for inducing a second mode of electromagnetic oscillation perpendicular to said plane, and each of said resonators of said set of resonators has a perturbation disposed in a peripheral region of the respective resonator which is distant from said plane.

25. A filter for an electromagnetic signal comprising:

a set of resonators spaced apart from each other and disposed about a common axis, each of said resonators extending parallel to each other and transversely of said axis;

a set of electrically conductive sheets interposed between successive ones of said resonators and spaced apart from said resonators, said electrically conductive sheets being parallel to each other, there being at least two resonators in said set of resonators, there being at least one sheet in said set of sheets, each of said sheets having a corresponding iris, the irises in respective ones of said sheets being operative for coupling said electromagnetic signal between neighboring ones of said resonators;

a ground plane located outside said set of resonators and parallel to said at least one resonator; and coupling means disposed adjacent to at least one resonator of said set of resonators for coupling said electromagnetic signal through said ground plane to said filter;

wherein said set of sheets comprises a plurality of said sheets, said filter further comprising means electrically connecting said sheets to realize an equipotential surface of said plurality of sheets.

26. A filter for an electromagnetic signal comprising:

a set of resonators spaced apart from each other and disposed about a common axis, each of said resonators extending parallel to each other and transversely of said axis;

a set of electrically conductive sheets interposed between successive ones of said resonators and spaced apart from said resonators, said electrically conductive sheets being parallel to each other, there being at least two resonators in said set of resonators, there being at least one sheet in said set of sheets, each of said sheets having a corresponding iris, the irises in respective ones of said sheets being operative for coupling said electromagnetic signal between neighboring ones of said resonators;

coupling means disposed adjacent to at least one resonator of said set of resonators for coupling said electromagnetic signal to said filter;

a ground plane located outside said set of resonators and parallel to said at least one resonator; and dielectric material disposed between said sheets and said resonators;

wherein said coupling means includes a coupling element positioned for coupling the electromagnetic signal through said ground plane to a point on said at least one resonator, said point being distant from said axis, said coupling element exciting in said at least one resonator a first mode of electromagnetic oscillation in a reference plane defined by said axis and a line between the axis and said point;

at least one of said resonators comprises a perturbation distant from said plane for inducing a second mode of electromagnetic oscillation perpendicular to said plane; and said dielectric material is one of quartz and a ceramic consisting of alumina or lanthanum aluminate.

27. A filter for an electromagnetic signal comprising:

a set of resonators spaced apart from each other and disposed about a common axis, each of said resonators extending parallel to each other and transversely of said axis;

a set of electrically conductive sheets interposed between successive ones of said resonators and spaced apart from said resonators, said electrically conductive sheets being parallel to each other, there being at least two resonators in said set of resonators, there being at least one sheet in said set of sheets, each of said sheets having a corresponding iris, the irises in respective ones of said sheets being operative for coupling said electromagnetic signal between neighboring ones of said resonators; and coupling means disposed adjacent to at least one resonator of said set of resonators for coupling said electromagnetic signal to said filter;

wherein said coupling means includes a coupling element positioned for coupling the electromagnetic signal to a point on said at least one resonator, said point being distant from said axis, said coupling element exciting in said at least one resonator a first mode of electromagnetic oscillation in a reference plane defined by said axis and a line between the axis and said point;

the filter further comprises a first ground plane and a second ground plane disposed transversely to said axis and spaced apart from said set of resonators, said at least one resonator is comprised of superconductor material, said set of resonators being located between said first and said second ground planes, said at least one resonator facing said first ground plane and a second of said resonators facing said second ground plane, each of said ground planes being parallel to said resonators and to said at least one sheet; and a spacing between two neighboring resonators of said set of resonators is less than approximately one-quarter wavelength of the electromagnetic signal to avoid generation of spurious modes.

28. A filter for an electromagnetic signal comprising:

a set of resonators spaced apart from each other and disposed about a common axis, each of said resonators extending parallel to each other and transversely of said axis;

a set of electrically conductive sheets interposed between successive ones of said resonators and spaced apart from said resonators, said electrically conductive sheets being parallel to each other, there being at least two resonators in said set of resonators, there being at least one sheet in said set of sheets, each of said sheets having a corresponding iris, the irises in respective ones of said sheets being operative for coupling said electromagnetic signal between neighboring ones of said resonators; and coupling means disposed adjacent to at least one resonator of said set of resonators for coupling said electromagnetic signal to said filter;

wherein said coupling means includes a coupling element positioned for coupling the electromagnetic signal to a point on said at least one resonator, said point being distant from said axis, said coupling element exciting in said at least one resonator a first mode of electromagnetic oscillation in a reference plane defined by said axis and a line between the axis and said point;

the filter further comprises a first ground plane and a second ground plane disposed transversely to said axis and spaced apart from said set of resonators, said at least one resonator is comprised of superconductor material, said set of resonators being located between said first and said second ground planes, said at least one resonator facing said first ground plane and a second of said resonators facing said second ground plane, each of said ground planes being parallel to said resonators and to said at least one sheet; and said coupling element comprises a slot in said first ground plane.

29. A filter for an electromagnetic signal comprising:

a set of resonators spaced apart from each other and disposed about a common axis, each of said resonators extending transversely of said axis;

a set of electrically conductive sheets interposed between successive ones of said resonators and spaced apart from said resonators, said electrically conductive sheets being parallel to each other, there being at least two resonators in said set of resonators, there being at least one sheet in said set of sheets, each of said sheets having a corresponding iris, the irises in respective ones of said sheets being operative for coupling said electromagnetic signal between neighboring ones of said resonators; and coupling means disposed adjacent to at least one resonator of said set of resonators for coupling said electromagnetic signal to said filter;

wherein a spacing between two neighboring resonators of said set of resonators is less than approximately one-quarter wavelength of the electromagnetic signal to avoid generation of spurious modes.

30. A filter for an electromagnetic signal comprising:

a set of resonators spaced apart from each other and disposed about a common axis, each of said resonators extending parallel to each other and transversely of said axis;

a set of electrically conductive sheets interposed between successive ones of said resonators and spaced apart from said resonators, said electrically conductive sheets being parallel to each other, there being at least two resonators in said set of resonators, there being at least one sheet in said set of sheets, each of said sheets having a corresponding iris, the irises in respective ones of said sheets being operative for coupling said electromagnetic signal between neighboring ones of said resonators; and coupling means disposed adjacent to at least one resonator of said set of resonators for coupling said electromagnetic signal to said filter;

wherein said coupling means includes a coupling element positioned for coupling the electromagnetic signal to a point on said at least one resonator, said point being distant from said axis, said coupling element exciting in said at least one resonator a first mode of electromagnetic oscillation in a reference plane defined by said axis and a line between the axis and said point;

said at least one resonator is comprised of superconductor material and comprises a perturbation distant from said plane for inducing a second mode of electromagnetic oscillation perpendicular to said plane;

said coupling means further comprises a second coupling element positioned for coupling said electromagnetic signal to a point on a second resonator of said set of resonators and distant from said axis; and the coupling point of said second resonator is disposed at a peripheral region of said second resonator on a further axial plane of said filter, said further axial plane being oriented perpendicularly to said reference plane.

31. A filter for an electromagnetic signal comprising:

a set of resonators spaced apart from each other and disposed about a common axis, each of said resonators extending parallel to each other and transversely of said axis;

a set of electrically conductive sheets interposed between successive ones of said resonators and spaced apart from said resonators, said electrically conductive sheets being parallel to each other, there being at least two resonators in said set of resonators, there being at least one sheet in said set of sheets, each of said sheets having a corresponding iris, the irises in respective ones of said sheets being operative for coupling said electromagnetic signal between neighboring ones of said resonators; and coupling means disposed adjacent to at least one resonator of said set of resonators for coupling said electromagnetic signal to said filter;

wherein said set of resonators comprises at least three resonators and wherein the spacings between said at least three resonator, differ for providing different amounts of coupling of power therebetween.

32. A filter for an electromagnetic signal comprising:

a set of resonators spaced apart from each other and disposed about a common axis, each of said resonators extending parallel to each other and transversely of said axis;

a set of electrically conductive sheets interposed between successive ones of said resonators and spaced apart from said resonators, said electrically conductive sheets being parallel to each other, there being at least two resonators in said set of resonators, there being at least one sheet in said set of sheets, each of said sheets having a corresponding iris, the irises in respective ones of said sheets being operative for coupling said electromagnetic signal between neighboring ones of said resonators;

coupling means disposed adjacent to at least one resonator of said set of resonators for coupling said electromagnetic signal to said filter;

dielectric material disposed between said sheets and said resonators;

a first ground plane and a second ground plane disposed transversely to said axis and spaced apart from said set of resonators, said set of resonators being located between said first and said second ground planes, said at least one resonator facing said first ground plane and a second resonator of said set of resonators facing said second ground plane;

wherein said coupling means includes a coupling element positioned for coupling the electromagnetic signal to a point on said at least one resonator, said point being distant from said axis, said coupling element exciting in said at least one resonator a first mode of electromagnetic oscillation in a reference plane defined by said axis and a line between the axis and said point;

said at least one resonator comprises a perturbation distant from said reference plane for inducing a second mode of electromagnetic oscillation perpendicular to said plane;

the iris in said at least one sheet has a first dimension parallel to said reference plane and a second dimension perpendicular to said reference plane, said first and said second dimension differing in length for providing a differential amount of coupling of electromagnetic oscillations between said first and said second modes;

said coupling means further comprises a second coupling element positioned for coupling power to a point of a second of said resonators of said set of resonators; and a spacing between two neighboring resonators of said set of resonators is less than approximately one-quarter wavelength of the electromagnetic signal to avoid generation of spurious modes.

33. A filter according to claim 32 wherein each of said resonators of said Set of resonators comprises superconductor material.

34. A filter according to claim 33 wherein said set of sheets comprises a plurality of said sheets, said filter further comprising means electrically connecting said sheets to realize an equipotential surface of said plurality of sheets, said set of resonators and said set of sheets each having a planar form and being parallel to each other.

35. A filter for an electromagnetic signal comprising:

a set of resonators spaced apart from each other and disposed about a common axis, each of said resonators extending parallel to each other and transversely of said axis;

a set of electrically conductive sheets interposed between successive ones of said resonators and spaced apart from said resonators, said electrically conductive sheets being parallel to each other, there being at least two resonators in said set of resonators, there being at least one sheet in said set of sheets, each of said sheets having a corresponding iris, the irises in respective ones of said sheets being operative for coupling said electromagnetic signal between neighboring ones of said resonators;

coupling means disposed adjacent to at least one resonator of said set of resonators for coupling said electromagnetic signal to said filter;

wherein said coupling means includes a coupling element positioned for coupling the electromagnetic signal to a point on said at least one resonator, said point being distant from said axis, said coupling element exciting in said at least one resonator a first mode of electromagnetic oscillation in a reference plane defined by said axis and a line between the axis and said point;

at least one resonator of said set of said resonators is comprised of superconductor material, and comprises a perturbation distant from said plane for inducing a second mode of electromagnetic oscillation perpendicular to said plane; and a spacing between two neighboring resonators of said set of resonators is less than approximately one-quarter wavelength of the electromagnetic signal to avoid generation of spurious modes.

36. A filter for an electromagnetic signal comprising:

a set of resonators spaced apart from each other and disposed about a common axis, each of said resonators extending parallel to each other and transversely of said axis;

a set of electrically conductive sheets interposed between successive ones of said resonators and spaced apart from said resonators, said electrically conductive sheets being parallel to each other, there being at least two resonators in said set of resonators, there being at least one sheet in said set of sheets, each of said sheets having a corresponding iris, the irises in respective ones of said sheets being operative for coupling said electromagnetic signal between neighboring ones of said resonators;

coupling means disposed adjacent to at least one resonator of said set of resonators for coupling said electromagnetic signal to said filter;

wherein said coupling means includes a coupling element positioned for coupling the electromagnetic signal to a point on said at least one resonator, said point being distant from said axis, said coupling element exciting in said at least one resonator a first mode of electromagnetic oscillation in a reference plane defined by said axis and a line between the axis and said point;

at least one resonator of said set of said resonators is comprised of superconductor material, and comprises a perturbation distant from said plane for inducing a second mode of electromagnetic oscillation perpendicular to said plane; and said coupling means is disposed adjacent a first one of said resonators of said set of resonators, and said perturbation is located in a second one of said resonators of said set of resonators.

* * * * *

UNITED STATES PATENT AND TRADEMARK OFFICE

CERTIFICATE OF CORRECTION

PATENT NO. : 5,484,764

DATED : Jan. 16, 1996

INVENTOR(S) : Fiedziuszko, S.J. and Curtis, J.A.

It is certified that error appears in the above-identified patent and that said Letters Patent is hereby corrected as shown below: On the title page: Item [19] and Item [75] inventor's name is spelled incorrectly. The correct inventor's name is Slawomir J. Fiedziuszko;

In The Claims:

Column 13, line 21, after "defined" insert --by--;

Column 14, line 15, the word "on" should be --one--;

Column 18, line 18, the word "resonator" should be --resonators--;

Signed and Sealed this

Seventh Day of May, 1996

*Attest:*

Bruce Lehman

BRUCE LEHMAN

*Attesting Officer*

*Commissioner of Patents and Trademarks*